US009417024B2

(12) United States Patent
Miller, III

(10) Patent No.: US 9,417,024 B2
(45) Date of Patent: Aug. 16, 2016

(54) ASYMMETRIC MUZZLE COMPENSATOR FOR FIREARM

(71) Applicant: Spike's Tactical, LLC, Apopka, FL (US)

(72) Inventor: Thomas James Miller, III, Lehigh Acres, FL (US)

(73) Assignee: Spike's Tactical, LLC, Apopka, FL (US)

( * ) Notice: Subject to any disclaimer, the term of this patent is extended or adjusted under 35 U.S.C. 154(b) by 7 days.

(21) Appl. No.: 14/495,941

(22) Filed: Sep. 25, 2014

(65) Prior Publication Data

US 2016/0091269 A1 Mar. 31, 2016

(51) Int. Cl.
*F41A 21/36* (2006.01)

(52) U.S. Cl.
CPC ..... *F41A 21/36* (2013.01)

(58) Field of Classification Search
CPC ..... F41A 21/28; F41A 21/30; F41A 21/34; F41A 21/36
USPC ..... 89/14.3, 14.4; 42/1.06; 181/223
See application file for complete search history.

(56) References Cited

U.S. PATENT DOCUMENTS

| | | | | | |
|---|---|---|---|---|---|
| 2,322,370 | A | | 6/1943 | Lance | |
| 3,971,285 | A | * | 7/1976 | Ellis | F41A 35/06 89/14.3 |
| 4,374,484 | A | * | 2/1983 | Bekker | F41A 21/38 89/14.3 |
| 4,691,614 | A | * | 9/1987 | Leffel | F41A 21/36 89/14.3 |
| D296,350 | S | * | 6/1988 | Cellini | F41A 21/34 89/14.3 |
| 4,879,942 | A | * | 11/1989 | Cave | F41A 21/36 89/14.3 |
| 5,092,223 | A | * | 3/1992 | Hudson | F41A 21/38 89/14.2 |
| 5,305,677 | A | * | 4/1994 | Kleinguenther | F41A 21/36 89/14.2 |
| 5,423,242 | A | * | 6/1995 | Schuemann | F41A 21/28 89/14.3 |
| 5,476,028 | A | * | 12/1995 | Seberger | F41A 21/36 89/14.3 |
| 5,675,107 | A | * | 10/1997 | Ledys | F41A 21/36 89/14.05 |
| 7,954,414 | B2 | | 6/2011 | Dueck et al. | |
| 8,695,474 | B2 | | 4/2014 | Overbeek Bloem et al. | |
| 2010/0257996 | A1 | * | 10/2010 | Noveske | F41A 21/34 89/14.2 |

* cited by examiner

*Primary Examiner* — Bret Hayes
(74) *Attorney, Agent, or Firm* — Wood Herron & Evans LLP

(57) ABSTRACT

Disclosed is a muzzle device for use with a muzzle end of a firearm barrel. The muzzle device includes a body having a central passageway extending along a central axis and being mountable to the muzzle end of the firearm barrel. A plurality of circumferentially spaced ports are provided on the body and extend generally radially outward from the central axis and open to the central passageway to provide fluid communication between the central passageway and an ambient environment external of the body. The ports are configured to direct propulsion gases generally radially outward therethrough when the firearm is discharged. The body includes a right-side portion and a left-side portion defined by a vertically-oriented imaginary plane, the ports being provided on the body such that the right-side portion directs a greater volume of propulsion gases therethrough than the left-side portion when the firearm is discharged.

15 Claims, 4 Drawing Sheets

ASYMMETRIC MUZZLE COMPENSATOR FOR FIREARM

FIELD OF INVENTION

This invention relates to devices installed on or integrated into the muzzle of a firearm. More specifically, the invention relates to a compensator intended to counteract the tendency of a firearm's barrel to rise after firing.

BACKGROUND OF THE INVENTION

The front end of a firearm (or the muzzle end of the barrel) tends to rise after firing. This occurs primarily because, for most firearms, the center line of the barrel is positioned above a center of contact established between the shooter and the firearm's grips or stock. The reactive force, or the recoil force, created when a bullet is fired and propellant gases, or propulsion gases, exit the muzzle, acts directly along the center line of the barrel and toward the rear of the firearm, where the shooter is generally positioned. When this line of force is above the center of contact between the shooter and the firearm, the force creates a "moment," or a rotational force, about the center of contact between the shooter and the firearm, which causes the firearm to rotate about the center of contact such that the muzzle end of the firearm rises upward. Such muzzle rise, or muzzle climb, is particularly evident for firearms having gripping features (e.g., a stock or grip) arranged such that a vertical distance (i.e., the moment arm) between the center line of the barrel and a center of contact with the shooter is particularly large.

A muzzle brake is a device connected to or on the muzzle of the barrel that redirects propellant gases to counter recoil forces. This may be accomplished in two general ways. First, a muzzle brake may present a surface against which the propellant gases impact, causing that transferred force to pull the barrel forward, counteracting part of the recoil forces. Second, redirection of propellant gases laterally, or even somewhat rearwardly, reduce or neutralize the effect of the muzzle blast.

In other cases, a muzzle attachment or porting that is provided along the top of the barrel or that is otherwise upwardly directed, used in combination with minimal or absent redirection or porting that is downwardly directed, exerts a downward force on the muzzle end of the barrel that at least partially counteracts the muzzle rise or muzzle climb described above. Such muzzle devices, whether a muzzle brake, flash suppressor, or compensator, include outlet ports that are asymmetric from top to bottom, about an imaginary horizontal plane. That is, porting is minimized or absent along the bottom of the device and is maximized toward the top and/or sides of the device. The porting in such devices, however, is symmetrical left to right, about an imaginary vertical plane.

Although not previously recognized, and generally not perceived by shooters, the muzzle rise or muzzle climb is not solely in an upward direction. For a right handed shooter, the muzzle rise or muzzle climb includes a vector somewhat to the right (from the shooter's perspective) of directly "up." Accordingly, after firing a shot, the shooter must move the muzzle downwardly and slightly to the left to realign with the target. Even with very effective compensators having left-to-right symmetrical porting that nearly eliminates muzzle rise or muzzle climb, some movement toward the left (again, for right handed shooters) is required to realign the barrel and sites on the target. Causes may include the ergonomics of how a firearm is typically held by a shooter, the effect of rifling (which usually spins the projectile in a right handed direction), and the cycling of an auto-loading action (including rotation and reciprocation of the bolt and ejection of a spent ammunition casing).

SUMMARY OF THE INVENTION

The present invention according to one embodiment provides a muzzle device for use with a muzzle end of a firearm barrel. The muzzle device includes a body having a forward end, a rearward end, and a central passageway extending therebetween along a central axis of the body. The body is mountable to the muzzle end of the firearm barrel such that the central axis is aligned with a barrel axis defined by a bore of the firearm barrel. The muzzle device further includes a plurality of ports provided on the body and spaced circumferentially about the central axis, the ports extending generally radially outward from the central axis and open to the central passageway to provide fluid communication between the central passageway and an ambient environment external of the body. The ports are configured to direct propulsion gases generally radially outward therethrough when the firearm is discharged. The body includes a right-side portion and a left-side portion defined by a vertically-oriented imaginary plane passing through the central axis of the body. The ports are provided on the body such that the right-side portion directs a greater volume of propulsion gases therethrough than the left-side portion when the firearm is discharged.

According to another feature of the invention, a circumferential spacing of the ports provided on the right-side portion may be smaller than a circumferential spacing of the ports provided on the left-side portion.

According to another feature of the invention, at least one of the ports provided on the right-side portion may be formed with a diameter that is larger than a diameter of each of the ports provided completely on the left-side portion.

According to another feature of the invention, the right-side portion may include an upper-right quadrant and a lower-right quadrant of the body, and the left-side portion may include an upper-left quadrant and a lower-left quadrant of the body, the upper and lower quadrants being defined by a horizontally-oriented imaginary plane passing through the central axis of the body, and the ports being provided on the body such that the upper-right quadrant directs a greater volume of propulsion gases therethrough than the upper-left quadrant when the firearm is discharged.

According to another feature of the invention, the body may include an inner chamber extending along the central axis and having a diameter that is larger than a diameter of the bore of the firearm barrel.

According to another feature of the invention, the muzzle device may include a blast cone positioned within an inner chamber of the body and having a rearwardly-directed surface configured to receive at least a portion of a forwardly-directed force exerted by the propulsion gases when the firearm is discharged.

According to another feature of the invention, the muzzle device may include at least one intake port provided on the body separate from the plurality of ports and extending into an inner chamber of the body, the at least one intake port configured to draw air from the ambient environment into the inner chamber when the firearm is discharged.

The present invention according to another embodiment provides a firearm barrel for use with a firearm. The firearm barrel includes a barrel body having a muzzle end from which a projectile exits when the firearm is discharged, a bore defining a barrel axis, and a plurality of ports provided at the muzzle end of the barrel body and spaced circumferentially about the barrel axis. The ports extend generally radially inward toward the barrel axis and open to the bore to provide fluid communication between the bore and an ambient environment external of the barrel body. the ports configured to direct propulsion gases generally radially outward therethrough when the firearm is discharged. The barrel body includes a right-side portion and a left-side portion defined by a vertically-oriented imaginary plane passing through the barrel axis, the ports being provided on the barrel body such that the right-side portion directs a greater volume of propulsion gases therethrough than the left-side portion when the firearm is discharged.

Various other features, benefits, and aspects of the present invention will become apparent to a person of ordinary skill in the art upon considering the drawing figures and detailed description below.

BRIEF DESCRIPTION OF THE DRAWINGS

Like reference numerals are used to indicate like parts throughout the various figures of the drawing, wherein.

DETAILED DESCRIPTION OF THE INVENTION

Figure 1:
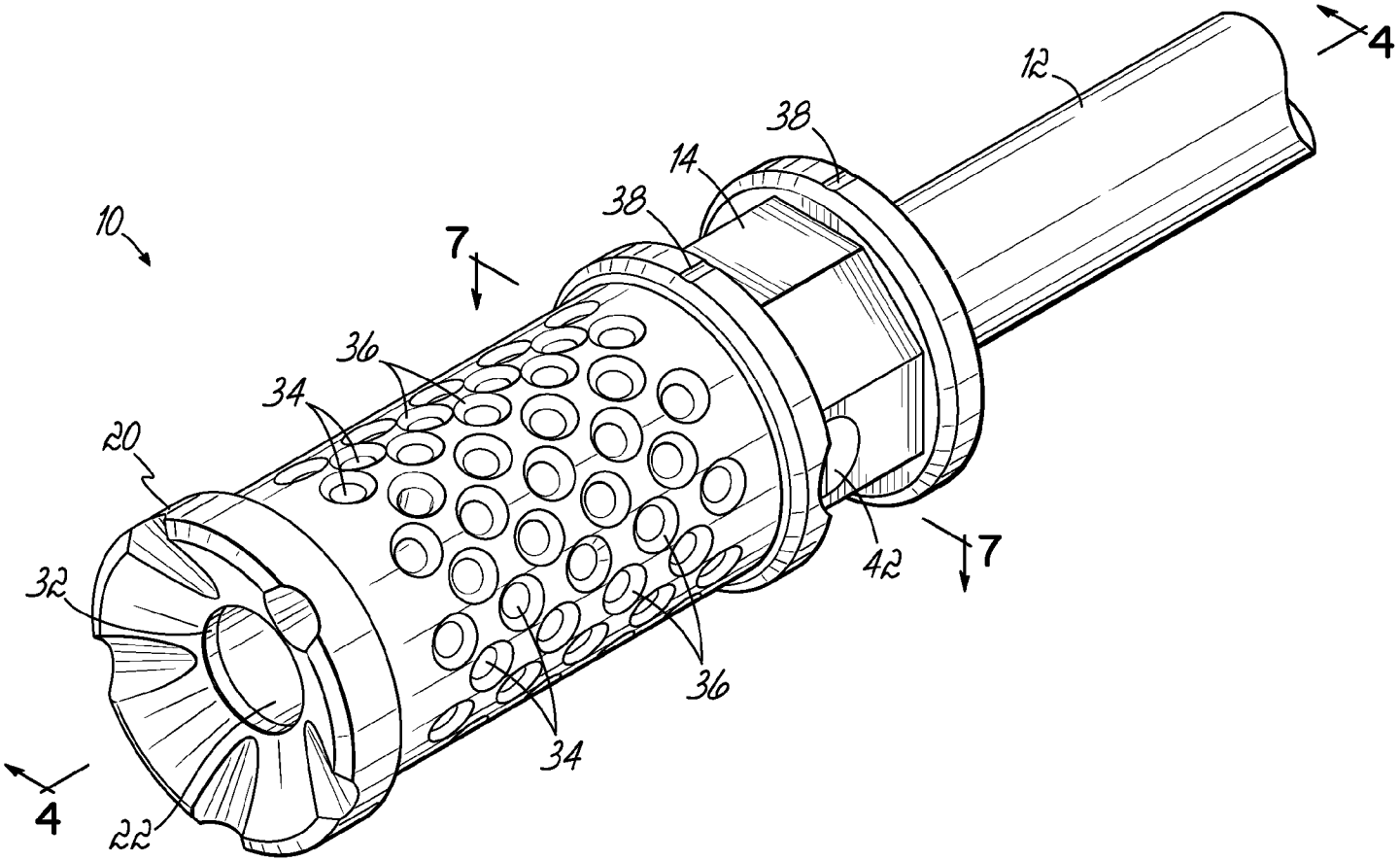
FIG. 1 is an isometric view of a compensator according to one embodiment of the present invention shown attached to the muzzle portion of a firearm barrel.
Figure 2:
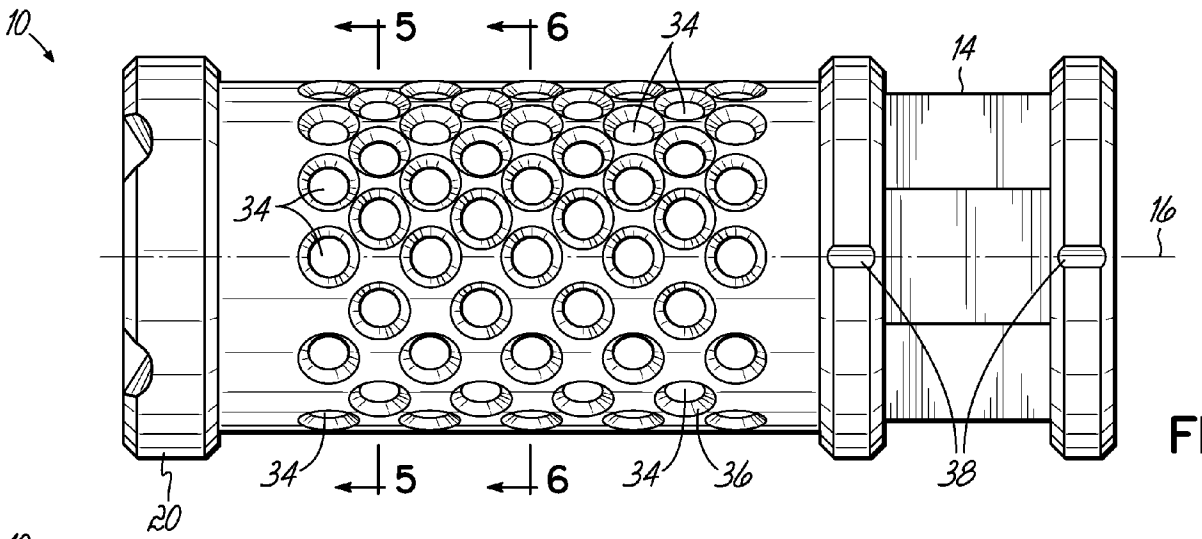
FIG. 2 is a top plan view thereof.
Figure 3:
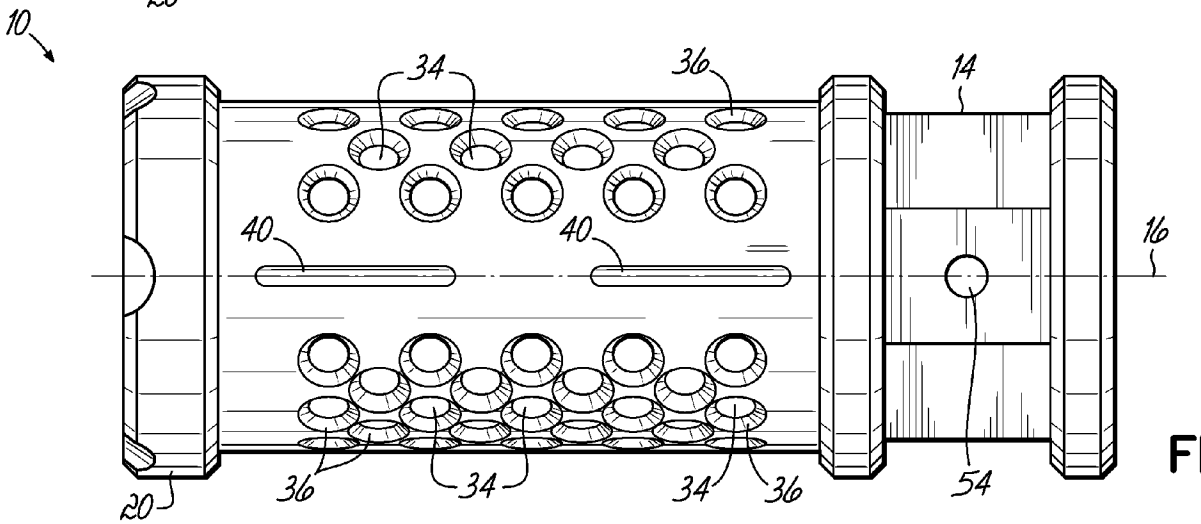
FIG. 3 is a bottom plan view thereof.

Referring now to the various figures of the drawing, and first to FIGS. 1-3, therein is shown at 10 a compensator according to one embodiment of the present invention. The illustrated device 10 is in the form of an attachment that may be removably coupled to the muzzle end of a firearm barrel 12, by threadedly engaging mounting threads 44 provided on a radially inner surface of the device 10 with threads 46 provided on a radially outer surface of the muzzle end of the barrel 12. The body of the device 10 may include one or more wrench flats 14 to facilitate attachment of the device 10 to the barrel 12. The body includes a central passageway having a central axis 16 that is aligned with the axis of the bore 18 of the barrel 12. At a forward end 20 of the device 10, the central passageway opens to an outlet opening 22, which is sized to allow free passage of a projectile therethrough. In practice, the outlet opening 22 must be slightly greater in diameter than the bore 18 of the barrel 12, the exact size of the outlet opening 22 being dependent on the caliber of the firearm.

Figure 4:
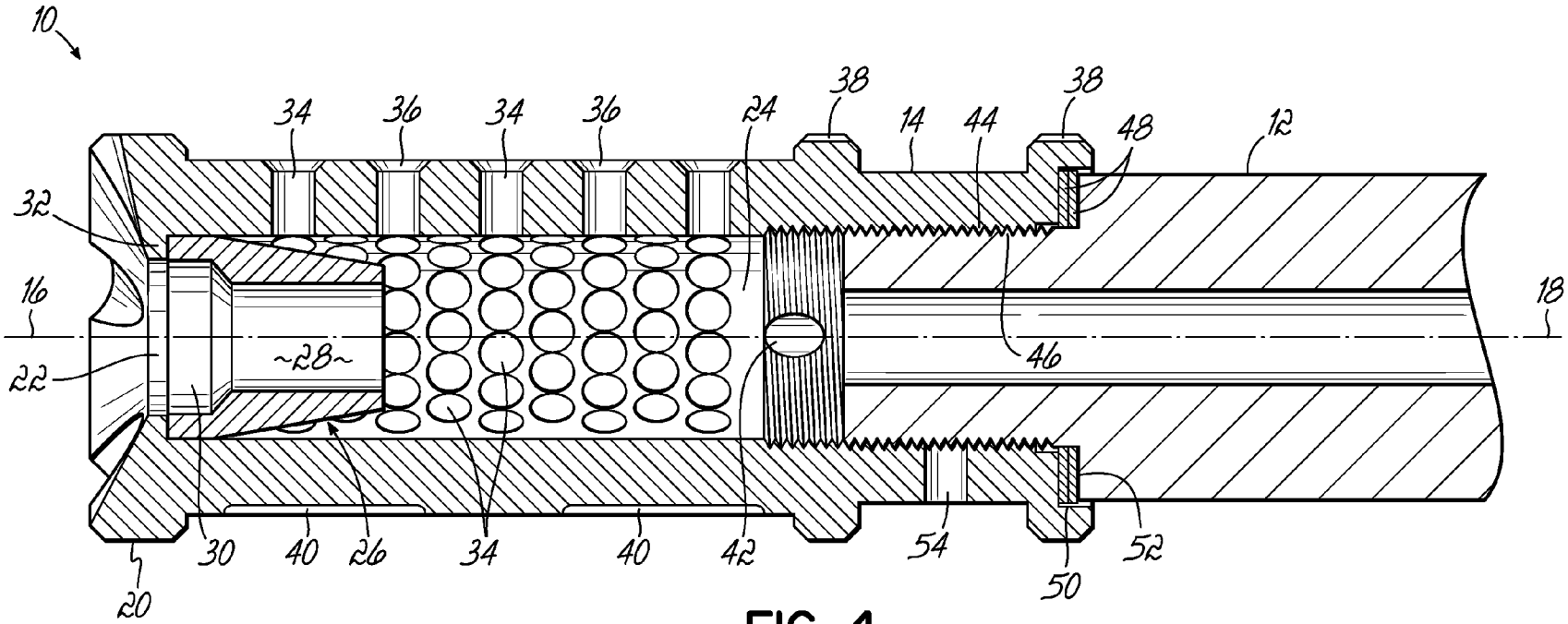
FIG. 4 is a longitudinal section view taken substantially along line 4-4 of FIG. 1.

As shown in FIG. 4, the body of the compensator 10 may include an inner chamber 24 having a cross-sectional area larger than that of the bore 18. For example, a diameter of the inner chamber 24 may be larger than the diameter of the bore 18 and may also be larger than the diameter of the outlet opening 22. According to one embodiment of the invention, the compensator 10 may include an internal blast cone 26 positioned in the inner chamber 24 near the forward end 20. This blast cone 26 may be made of a material selected to be particularly erosion resistant, such as AISI T15 High Speed Tool Steel. The blast cone 26 includes an axial passageway 28 coaxially aligned with the axis 16 of the compensator 10 and with the bore 18. The axial passageway 28 of the blast cone 26 may include a forward portion 30 that is enlarged in cross section and which may substantially match a cross-sectional area or diameter of the outlet opening 22. The inner chamber 24 of the compensator 10 may be formed to have an annular wall 32 projecting radially inward at the forward end 20 and against which the blast cone 26 may be seated and secured. Accordingly, the blast cone 26, which is subjected to a considerable amount of forwardly-directed force exerted by propellant gases escaping the muzzle of the barrel 12 when a projectile is fired, cannot be dislodged forwardly from its proper position within the inner chamber 24. The blast cone 26 may be sized to press fit into position against the annular wall 32 and/or may be attached in place, such as by welding or brazing. A rearwardly-directed frusto-conical shape of the blast cone 26 provides a surface of increased area against which high velocity propellant gases impinge when the firearm is discharged. Consequently, a portion of the forwardly-directly force exerted by the propellant gases is transferred to the compensator 10 and to the barrel 12, thereby counteracting at least a portion of the rearwardly-directed recoil forces exerted by the firearm. Additionally, the frusto-conical shape of the blast cone 26 facilitates redirection of the propellant gases through radial openings, described below.

The body of the compensator 10 includes a ported section having a plurality of outlets or ports 34 for venting and directing high velocity propulsion gases from the inner chamber 24 radially outwardly in directions substantially transverse to the central axis 16. As shown in the illustrated embodiment, these ports 34 may extend radially through the body of the compensator 10, connecting the inner chamber 24 with the atmosphere surrounding the device 10 in fluid communication. If desired, the ports 34 may include a flared portion 36 at a radially outer location where the port 34 meets the exterior surface of the compensator 10. These flared portions 36 may be formed conically, such as with a counter sink mill tool, or may be cupped, such as with a ball end mill. The flared portion 36 helps to more rapidly disperse the high velocity gases exiting through the ports 34.

As is particularly evident in FIGS. 2 and 3, showing top and bottom views of the compensator 10, respectively, the ports 34 may be spaced along the axial length of the compensator 10, such as in circumferentially staggered rows, where the ports 34 of one row are offset in a circumferential direction from corresponding ports 34 of an adjacent row. The distribution of the ports 34 and, accordingly, the collective cross-sectional area and volume defined by the ports 34 and thus the volume of propellant gases expelled therethrough, is asymmetrical in a left-to-right, side-to-side relationship. In other words, the ports 34 are arranged asymmetrically about a vertically-oriented imaginary plane that passes through the central axis 16 and defines left and right portions of the compensator 10.

Figure 6:
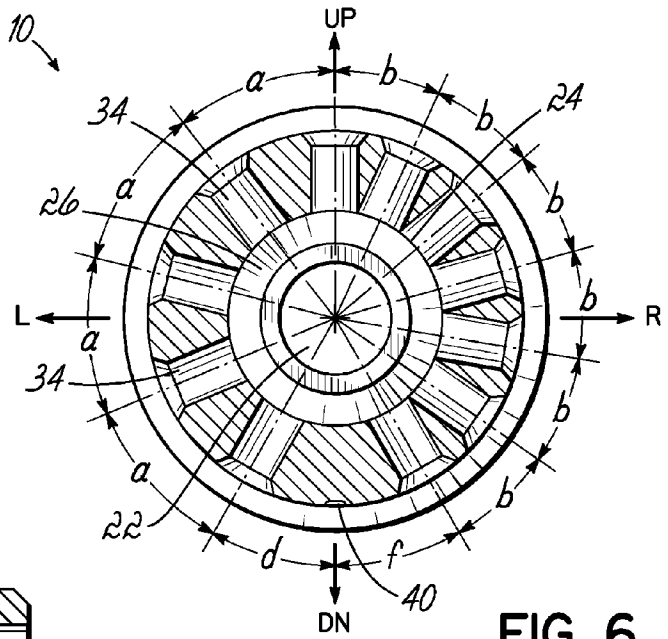
FIG. 6 is a cross sectional view taken substantially along line 6-6 of FIG. 2.
Figure 5:
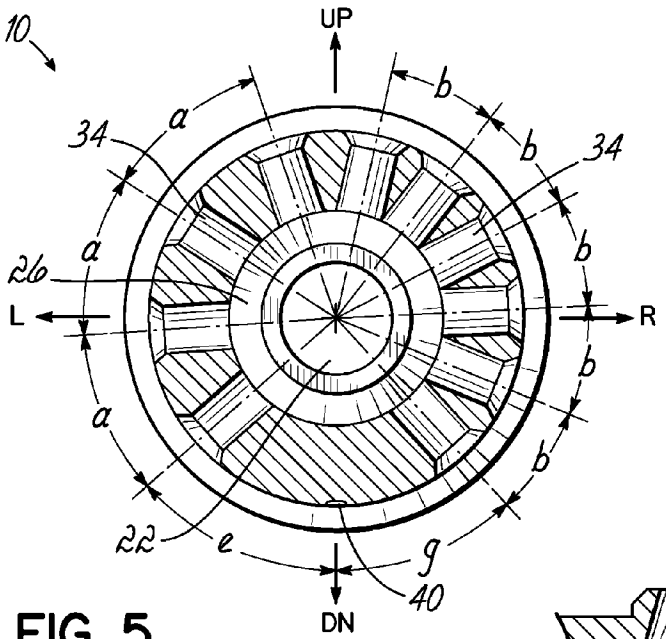
FIG. 5 is a cross sectional view taken substantially along line 5-5 of FIG. 2.

Referring now also to FIGS. 5 and 6, therein are shown cross-sectional views along representative axially spaced and circumferentially staggered rows of outlet ports 34. Looking from the perspective of a shooter holding a firearm having a compensator 10 according to the present invention (i.e., from the rear of the firearm looking forward, down the barrel 12), the circumferential portions of the compensator 10 body may be considered in four sections or quadrants. A first, upper-right quadrant may be visually defined between a twelve o'clock position (directly up) and a three o'clock position (directly to the right); a second, lower-right quadrant may be visually defined between the three o'clock position (directly to the right) and a six o'clock position (directly down); a third, lower-left quadrant may be visually defined between the six o'clock position (directly down) and a nine o'clock position (directly to the left); and a fourth, upper-left quadrant may be visually defined between the nine o'clock position (directly to the left) and the twelve o'clock position (directly up). In this manner, the twelve o'clock and six o'clock positions collectively define a vertically-oriented imaginary plane passing through the central axis 16, thereby defining a right-side portion and a left-side portion of the body of the device 10. Similarly, the nine o'clock and three o'clock positions collective define a horizontally-oriented imaginary plane passing through the central axis 16, thereby defining a top portion and a bottom portion of the body of the device 10.

Because orientation of the compensator 10, relative to vertical and horizontal when the firearm is being held by a shooter, is important to understanding the present invention and proper installation of the device 10, the compensator 10 body may include upper indexing marks 38 (shown in FIG. 2) indicating a top portion of the device 10 to be oriented upwardly in alignment with the twelve o'clock position, and lower indexing marks 40 (shown in FIG. 3) indicating a bottom portion of the device 10 to be oriented downwardly in alignment with the six o'clock position. As shown in FIG. 4, because orientation of the device 10 on the barrel 12 relative to vertical and horizontal is important, and because the mounting threads 44 on the device 10 and threads 46 on the barrel may be cut without regard to vertical or horizontal orientation, it may be necessary to "time" the final position of the device 10, during installation thereof onto the barrel 12, with one or more shims 48. As shown, the shims 48 may be seated within a pocket 50 formed at the rear of the device 10 and against a radially extending annular shoulder 52 of the barrel 12. Through use of the shims 48, the device 10 may be rotatably positioned such that the upper indexing marks 38 are substantially aligned with the twelve o'clock position (directly up), and the lower indexing marks 40 are substantially aligned with the six o'clock position (directly down). Additionally, if desired, the device 10 may be permanently affixed to the barrel 12 by pinning, such as through a provided opening 54 located at the threaded portion 44, so as to maintain the device 10 in the desired rotational orientation relative to the barrel 12.

According to a feature of the illustrated embodiment, the circumferential spacing of the radial ports 34 is closer, thereby providing an increased outlet flow of propellant gases, in the upper-right quadrant than in the upper-left quadrant. This left-to-right, asymmetric relationship may also be applied, if desired, to upper portions of the lower-right quadrant and the lower-left quadrant. As shown in the illustrated embodiment, the circumferential spacing of the outlet ports 34 is varied to achieve this differentiation. FIGS. 5 and 6 show that the circumferential spacing between ports 34 in the upper-left and lower-left quadrants (spacing shown at "a") may be at approximately 37.5 degrees, while the circumferential spacing of ports 34 in the upper-right and lower-right quadrants (spacing shown at "b") may be approximately 25 degrees. In either case, generally none of the ports 34 are oriented directly downward toward the six o'clock position. Additionally, the ports 34 in the lower-left and lower-right quadrants may be fewer in number or smaller in combined cross-sectional area, and thus volume, than the ports 34 in the corresponding upper-left and upper-right quadrants, respectively. As shown in FIGS. 5 and 6, the lowermost port 34 in the lower-left quadrant may be positioned at approximately 30 degrees (shown at "d") to 48.5 degrees (shown at "e") from the bottommost point of the device 10 at the six o'clock position, indicated by the lower indexing mark 40. Similarly, the lowermost port 34 in the lower-right quadrant may be positioned at approximately 30 degrees (shown at "f") to approximately 42.5 degrees (shown at "g") from the bottommost point of the device 10, indicated by the lower indexing mark 40.

If desired, though not illustrated, the circumferential spacing of one or more rows of ports 34 may vary progressively in circumferential directions about the device 10. More particularly, the circumferential spacing of the ports 34 may incrementally decrease, such that the ports 34 become more closely-spaced, in circumferential directions advancing toward and into the upper-right quadrant. Similarly, in such configuration, the circumferential spacing of the ports 34 incrementally increases, such that the ports 34 become further spaced apart, in circumferential directions advancing out of and away from the upper-right quadrant. Additionally, as shown in the illustrated embodiment, the axial spacing of the staggered rows of ports 34 may remain substantially constant along a length of the ported section of the device 10.

In an alternative embodiment, not shown herein, rather than forming the ports 34 with uniform diameters and positioning the ports 34 with varying circumferential spacing for mitigating muzzle rise, as described above, the same effect may be achieved by forming the ports 34 with diameters that vary circumferentially about the device 10, such that a collective volume defined by the ports 34 positioned in the upper-right quadrant is greater than a collective volume defined by the ports 34 positioned in each of the lower-right quadrant, the upper-left quadrant, and the lower-left quadrant. For example, in one embodiment, the ports 34 positioned in the upper-right quadrant may each be formed with a uniform diameter that is larger than a uniform diameter of each of the ports 34 positioned in the upper-left quadrant. In another embodiment, the ports 34 in one or more of the staggered rows may be formed with diameters that progressively increase in circumferential directions, about the device 10, advancing toward and into the upper-right quadrant, which diameters thus progressively decrease in circumferential directions, about the device 10, advancing out of and away from the upper-right quadrant. In yet another embodiment, if desired, the axial spacing of the ports 34 may be varied. For example, the axial spacing may progressively increase or decrease along a length of the ported section of the device 10.

Persons skilled in the art will appreciate that the ports 34 may be provided on the body of the device 10 in various arrangements and with various circumferential spacings and diameters in addition to those shown and described herein. Important to the present invention according to the various embodiments, however, is that the effective porting of the upper-right quadrant of the device 10 exceeds that of the upper left-quadrant, or that the effective porting of the upper-right quadrant exceeds that of any of the other three quadrants. In this manner, the ports 34 provided on the upper-right quadrant of the device 10 may direct a greater volume of propulsion gases therethrough than each of the upper-left quadrant, the lower-left quadrant, and the lower-right quadrant when the firearm is discharged.

Figure 7:
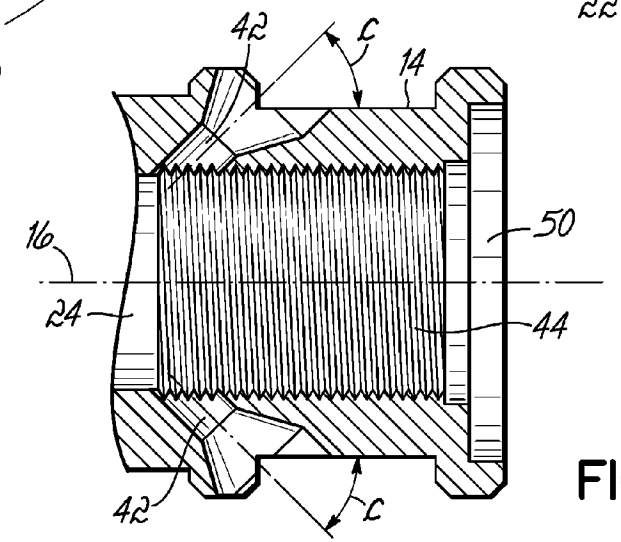
FIG. 7 is a fragmentary sectional view of the compensator taken substantially along line 7-7 of FIG. 1.

Referring now to FIG. 7, as well as FIGS. 1 and 4, another feature of the present invention may include lateral intake ports 42. These intake ports 42 are positioned toward the rear of the compensator 10 body to provide fluid communication between the atmosphere outside the device 10 and a rear portion of the inner chamber 24 at a position immediately forward of the muzzle of the barrel 12. The intake ports 42 may be angled relative to the central axis 16, as shown at "c," to enhance draw of outside air into the inner chamber 24 (such as by the Venturi effect) as high velocity propulsion gases exit the bore 18 into the inner chamber 24 and outwardly through the radial ports 34 or the forward outlet opening 22. The angle "c," for example, may be about 45 degrees to enhance draw from the rear of toward the front in the direction of gasses exiting the bore 18. Drawing in oxygenated air through the intake ports 42 can enhance burning of any residual propellant powder and cooling of the propulsion gases prior to their expulsion through the radial ports 34. Although two intake ports 42 are shown in the illustrated embodiment, any desired number may be used.

Although the embodiment illustrated and described above is in the form of an asymmetric compensator 10 attached as a separate unit to a firearm barrel 12, alternatively the device 10 may integrally formed with the barrel 12 by forming ports in the muzzle end of the barrel 12, the ports penetrating through an exterior surface of the barrel 12 and into the bore 18. Important to the present invention in such an embodiment is that the size and/or spacing of the ports provides increased gas flow in the upper-right quadrant of the ported section of the barrel 12, as compared to that provided by ports in the upper-left quadrant of the ported section of the barrel 12, as similarly described above.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention.

What is claimed is:

1. A muzzle device for use with a muzzle end of a firearm barrel, the muzzle device comprising:

a body having a forward end, a rearward end, and a central passageway extending therebetween along a central axis of the body, the body being mountable to the muzzle end of the firearm barrel such that the central axis is aligned with a barrel axis defined by a bore of the firearm barrel; and a plurality of ports provided on the body and spaced circumferentially about the central axis, the ports extending generally radially outward from the central axis and open to the central passageway to provide fluid communication between the central passageway and an ambient environment external of the body, the ports configured to direct propulsion gases generally radially outward therethrough when the firearm is discharged;

wherein the body includes a right-side portion and a left-side portion defined by a vertically-oriented imaginary plane passing through the central axis of the body, the ports being provided on the body such that the right-side portion directs a greater volume of propulsion gases therethrough than the left-side portion when the firearm is discharged;

the right-side portion includes an upper-right quadrant and a lower-right quadrant of the body, and the left-side portion includes an upper-left quadrant and a lower-left quadrant of the body, the upper and lower quadrants being defined by a horizontally-oriented imaginary plane passing through the central axis of the body, and the ports being provided on the body such that the upper-right quadrant directs a greater volume of propulsion gases therethrough than the upper-left quadrant when the firearm is discharged; and at least one of:

a circumferential spacing of the ports provided on the upper-right quadrant is smaller than a circumferential spacing of the ports provided on the upper-left quadrant; or at least one of the ports provided on the upper-right quadrant is formed with a diameter that is larger than a diameter of each of the ports provided completely on the upper-left quadrant.

2. The muzzle device of claim 1, wherein a circumferential spacing of the ports provided on the right-side portion is smaller than a circumferential spacing of the ports provided on the left-side portion.

3. The muzzle device of claim 1, wherein at least one of the ports provided on the right-side portion is formed with a diameter that is larger than a diameter of each of the ports provided completely on the left-side portion.

4. The muzzle device of claim 1, wherein the ports are provided on the body such that the upper-right quadrant directs a greater volume of propulsion gases therethrough than each of the upper-left quadrant, the lower-left quadrant, and the lower-right quadrant when the firearm is discharged.

5. The muzzle device of claim 1, wherein a circumferential spacing of the ports provided on the body progressively decreases in a circumferential direction toward the upper-right quadrant.

6. The muzzle device of claim 1, wherein at least one of the ports provided on the upper-right quadrant is formed with a diameter that is larger than a diameter of each of the ports provided completely on each of the upper-left quadrant, the lower-left quadrant, and the lower-right quadrant.

7. The muzzle device of claim 1, wherein the ports on the body are formed with corresponding diameters that progressively increase in a circumferential direction toward the upper-right quadrant.

8. The muzzle device of claim 1, wherein the body includes an inner chamber extending along the central axis, the inner chamber having a diameter that is larger than a diameter of the bore of the firearm barrel.

9. The muzzle device of claim 1, further comprising:

a blast cone positioned within an inner chamber of the body and having a rearwardly-directed surface configured to receive at least a portion of a forwardly-directed force exerted by the propulsion gases when the firearm is discharged.

10. The muzzle device of claim 9, wherein the blast cone is seated against a radially extending annular wall proximate the forward end of the body.

11. The muzzle device of claim 1, further comprising:

at least one intake port provided on the body separate from the plurality of ports and extending into an inner chamber of the body, the at least one intake port configured to draw air from the ambient environment into the inner chamber when the firearm is discharged.

12. A firearm barrel for use with a firearm, comprising:

a barrel body having a muzzle end from which a projectile exits when the firearm is discharged;

a bore defining a barrel axis; and a plurality of ports provided at the muzzle end of the barrel body and spaced circumferentially about the barrel axis, the ports extending generally radially outward from the barrel axis and open to the bore to provide fluid communication between the bore and an ambient environment external of the barrel body, the ports configured to direct propulsion gases generally radially outward therethrough when the firearm is discharged;

wherein the barrel body includes a right-side portion and a left-side portion defined by a vertically-oriented imaginary plane passing through the barrel axis, the ports being provided on the barrel body such that the right-side portion directs a greater volume of propulsion gases therethrough than the left-side portion when the firearm is discharged;

the right-side portion includes an upper-right quadrant and a lower-right quadrant of the body, and the left-side portion includes an upper-left quadrant and a lower-left quadrant of the body, the upper and lower quadrants being defined by a horizontally-oriented imaginary plane passing through the barrel axis of the barrel body, and the ports being provided on the barrel body such that the upper-right quadrant directs a greater volume of propulsion gases therethrough than the upper-left quadrant when the firearm is discharged; and at least one of:

a circumferential spacing of the ports provided on the upper-right quadrant is smaller than a circumferential spacing of the ports provided on the upper-left quadrant; or at least one of the ports provided on the upper-right quadrant is formed with a diameter that is larger than a diameter of each of the ports provided completely on the upper-left quadrant.

13. The firearm barrel of claim 12, wherein a circumferential spacing of the ports provided on the right-side portion is smaller than a circumferential spacing of the ports provided on the left-side portion.

14. The firearm barrel of claim 12, wherein at least one of the ports provided on the right-side portion is formed with a diameter that is larger than a diameter of each of the ports provided completely on the left-side portion.

15. The firearm barrel of claim 12, wherein the ports are provided on the barrel body such that the upper-right quadrant directs a greater volume of propulsion gases therethrough than each of the upper-left quadrant, the lower-left quadrant, and the lower-right quadrant when the firearm is discharged.

* * * * *